US005490885A

United States Patent [19]

Miller et al.

[11] Patent Number: 5,490,885

[45] Date of Patent: Feb. 13, 1996

[54] METAL TREATMENT

[75] Inventors: William S. Miller, Maidstone; Roger Grimes, Halton, both of England

[73] Assignee: Alcan International Limited, Montreal, Canada

[21] Appl. No.: 284,298

[22] Filed: Aug. 3, 1994

Related U.S. Application Data

[63] Continuation of Ser. No. 776,386, filed as PCT/GB/00429, Mar. 20, 1990, abandoned.

[30] Foreign Application Priority Data

Mar. 21, 1989 [GB] United Kingdom ..... 8906468

[51] Int. Cl.[6] ..... C22F 1/04

[52] U.S. Cl. ..... 148/564; 148/688; 148/691; 148/692; 148/695; 148/696; 148/437; 148/438; 148/439; 148/440; 420/902

[58] Field of Search ..... 148/564, 688, 148/695, 696, 437, 438, 439, 440, 691, 692; 420/902

[56] References Cited

U.S. PATENT DOCUMENTS

| | | | |
|---|---|---|---|
| 4,021,271 | 5/1977 | Roberts | 148/440 |
| 4,483,719 | 11/1984 | Furrer et al. | 148/437 |
| 4,486,242 | 12/1984 | Ward et al. | 420/902 |
| 4,531,977 | 7/1985 | Mishima et al. | 420/902 |
| 4,618,382 | 10/1986 | Miyagi et al. | 148/415 |

FOREIGN PATENT DOCUMENTS

| | | |
|---|---|---|
| 0084571 | 8/1983 | European Pat. Off. . |
| 0104774 | 4/1984 | European Pat. Off. . |

OTHER PUBLICATIONS

Superplastic Forming of Structural Alloys, Proceedings of a Symposium, 21–24 Jun. 1982, San Diego, California, edited by N. E. Paton et al., The Metallurgical Society of AIME, J. A. Wert: "Grain refinement and grain size control", pp. 69–83, see p. 73, para. 3; p. 74, para.2, fig.3; table 1.

Aluminum–Lithium Alloys III, Proceedings of the Third International Aluminum–Lithium Conference, 8–11 Jul. 1985, Oxford, edited by C. Baker et al., The Institute of Metals, (London, GB), J. Wadsworth et al.: "Superplastic aluminum–lithium alloys", pp. 199–212, see table 2; abstract.

*Primary Examiner*—David A. Simmons
*Assistant Examiner*—Robert R. Koehler
*Attorney, Agent, or Firm*—Browdy and Neimark

[57] ABSTRACT

A method of treating a blank of an aluminium base alloy comprising a combination of heat treatments and cold forming operations to produce a highly recovered semi-fabricated wrought product that is not statically recrystallized and that is inherently non-superplastic and is capable of superplastic deformation only after an initial non-superplastic deformation to achieve dynamic recrystallization.

16 Claims, 10 Drawing Sheets

ELONG (%)
550
500
450
400
350
300
250
200
150
100
50
0
400
410
420
430
440
450
460
470
480
490
500
510
520
530
540
550
TEMPERATURE DEG. C.
Preheated 20 mins strained at 3.4mm/sec.
8090 No blank heat treatment (a)
8090 Blank heat treatment (d)
8091 No blank heat treatment (a)
8091 Blank heat treatment (d)

FIG. 5
50% Strain
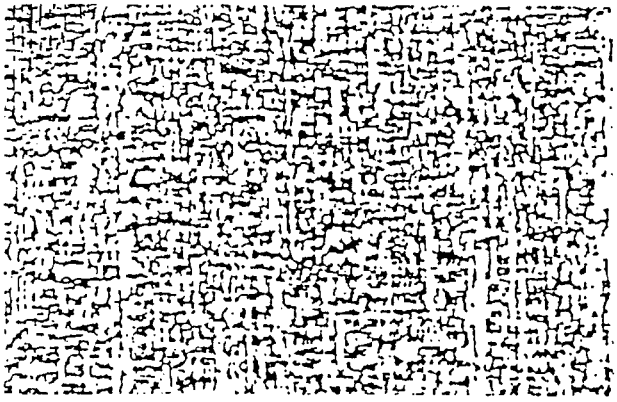
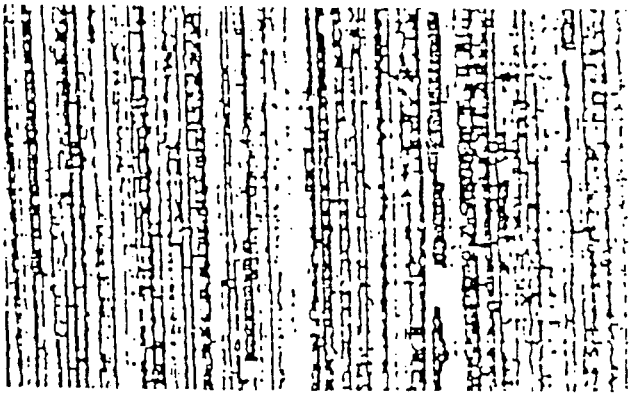
FIG. 5A
50% Strain
FIG. 6
100% Strain
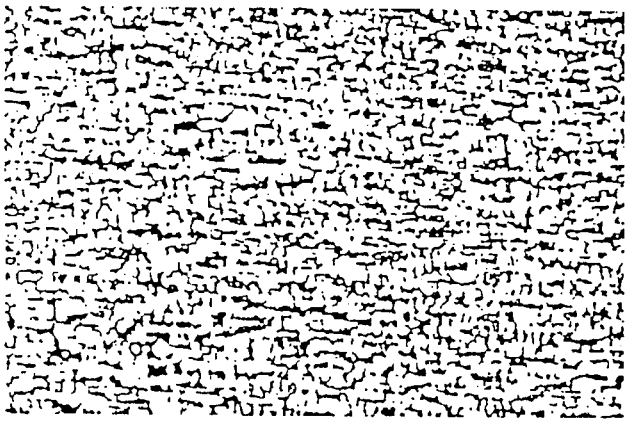
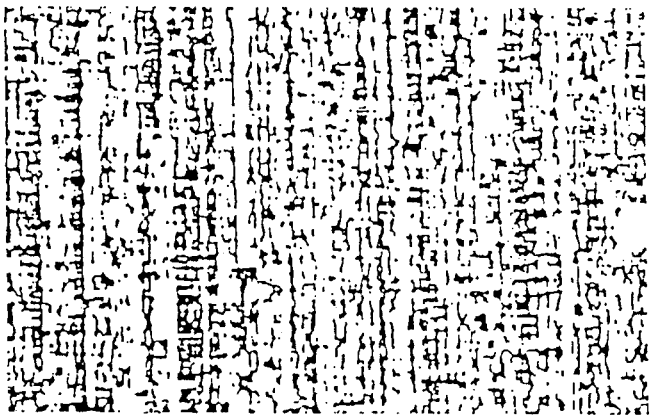
FIG. 6A
100% Strain FIG. 7
200% Strain
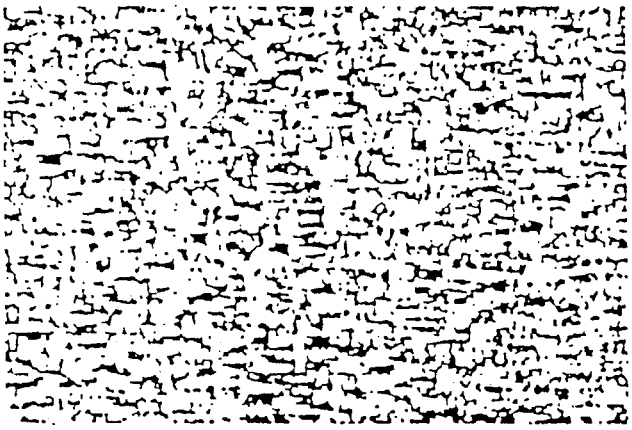
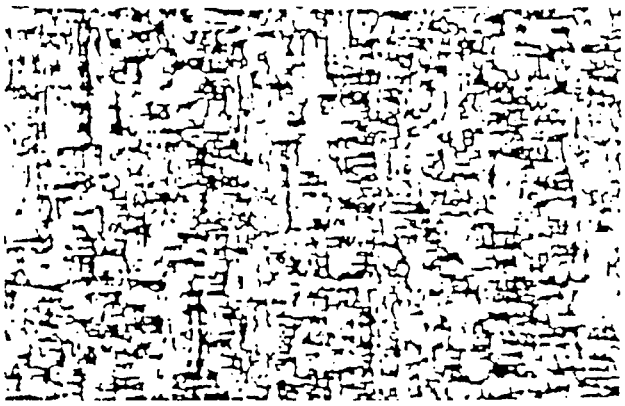
FIG. 7A
200% Strain
FIG. 8
500% Strain (Failure)
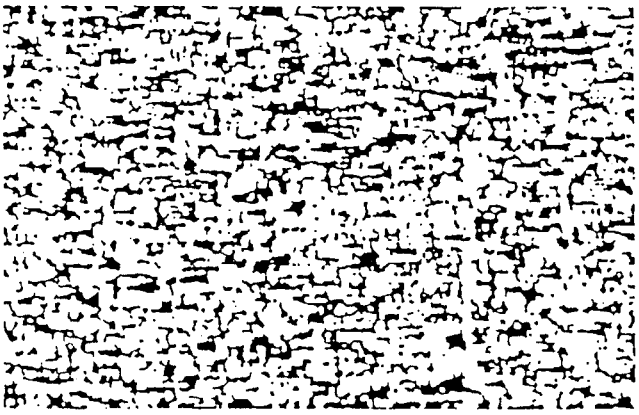
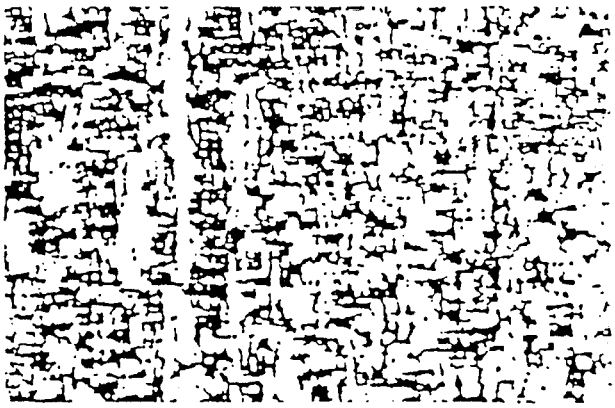
FIG. 8A
300% Strain (Failure)

SPF DUCTILITY %
1500
1400
1300
1200
1100
1000
900
800
700
600
500
400
300
200
100
0
1.5
3.4
12.5
28.4
45.9
STRAIN RATE mm/min.
Blank heat treated.
As rolled annealed.
Blank heat treated and annealed.
As rolled.
AS-ROLLED IS CURRENT PROCESSING.

METAL TREATMENT

This application is a continuation of application Ser. No. 07/776,386 filed Nov. 21, 1991, now abandoned, itself a national stage of PCT/GB/90/00429 filed Mar. 20, 1990.

FIELD OF INVENTION

This invention relates to the treatment of aluminium base alloys to enable superplastic deformation thereof to be achieved. It also includes a method of superplastically deforming such alloys.

BACKGROUND

Superplastic behaviour in a number of aluminium alloys is known. It is generally required that the alloy should have a fine, stable, grain size (1 to 10 microns) or be capable of achieving such a grain size during hot deformation; be deformable at a temperature not less than 0.7 Tm (melting temperature) and at strain rates in the range $10^{-2}$ to $10^{-5}$ $sec^{-1}$.

In this specification where four figure numbers are used to specify aluminium alloys those are as designated by the Aluminum Association Inc.

It has been found that the two most important routes to achieve superplasticity are as follows:

(1) With alloys which have a composition suitable for superplastic deformation but a grain structure which precludes it. With such alloys the grain structure can frequently be modified by an initial non-superplastic deformation step at a suitable forming temperature to induce dynamic recrystallisation so that a fine recrystallised grain structure is progressively developed and superplastic deformation can then take place. Such alloys may for example include 2004 and its derivatives and the process is described in UK Patent 1456050.

Aluminium/lithium alloys such as 8090 and 8091 appear to possess many of the characteristics of the 2004 type in that they can be made to develop a fine grain structure by dynamic recrystallisation from an original grain structure not suitable for superplastic deformation. (see R. Grimes and W. S. Miller in "Aluminium-Lithium 2, Monterey, Calif. 1984"). We have also shown, in UK Patent 2,139,536 how superplastic deformation of an Al/Li alloy can be achieved by modifying its high temperature deformation characteristics.

(2) with alloys such as 7075 and 7475 that are subjected to a static recrystallisation treatment as their final stage in complex thermomechanical processing to develop a fine, stable, grain structure. Such alloys are then inherently capable of subsequent superplastic deformation. Reference is made to work done by Rockwell International and to the publications "Superplasticity in High Strength Aluminium Alloys" pp. 173 to 189 and "Superplastic Forming of Structural Alloys", AIME New York 1982 (ISBN O-89520-389-8).

More recently it has been shown (J. Wadsworth, C. A. Henshall and T. G. Nieh "Superplastic Aluminium-Lithium alloys" in Aluminium Lithium Alloys 3 ed. C. Baker, P. J. Gregson, S. J. Harris and C. J. Peel, Pub. Inst of Metals 1986 p 199) that this type of processing route can also be applied to a variety of aluminium-lithium based alloys to create a superplastically deformable grain structure.

Aluminium/lithium alloys are therefore unusual in that both processing routes can be applied to the same starting alloy chemistry to achieve superplasticity. Work by Wadsworth et al (see above) has shown that good superplastic performance can be achieved by either process route.

Thus the two most important superplastic deformation routes, as discussed above, can be summarised as follows.

Route 1 (corresponding with paragraph numbered 1 above)

Hot rolled product

Heavy cold deformation

Dynamic recrystallisation

Superplastic deformation

In the case of 2004 and its derivatives it is essential, for Route 1, to cast the ingot in such a way that it is supersaturated with zirconium.

Route 2 (corresponding with paragraph numbered 2 above)

Hot rolled product

Solution treatment

Overageing process

Cold or Warm deformation

Static recrystallisation

Superplastic deformation

It must be emphasised that these two routes have been developed separately in respect of different types of alloys. Apart from each starting from a hot rolled product and ending in a superplastic deformation step they differ considerably in conformity with the differing properties of the alloys to which they have been applied.

In many aluminium base alloys grain control constituents such as zirconium are included and when the Zr content increases above about 0.15% casting to produce a good product becomes progressively (and considerably) more difficult.

SUMMARY OF INVENTION

The basis of the present invention is that we have now unexpectedly found that with many alloys falling in the category of numbered paragraph 2 above, suitable treatment enables them to be dynamically recrystallised as set out in numbered paragraph I above. For example some of the paragraph 2 alloys contain, in well known manner, sufficient Zr (or other similar addition) to act as a grain controlling constituent and/or to prevent static recrystallisation. Others normally contain no such addition.

According to one aspect of the present invention there is provided a method of treating a blank of an aluminium base alloy characterised by a combination of heat treatments and cold forming operations to produce a highly recovered semi-fabricated wrought product that is not statically recrystallised and that is inherently non-superplastic and is capable of superplastic deformation only after an initial non-superplastic deformation to achieve dynamic recrystallisation.

According to another aspect of the present invention there is provided a method of treating a previously hot-rolled blank of an aluminium base alloy to produce a highly recovered semi-fabricated wrought product that is not statically recrystallised and that is inherently non-superplastic and is capable of superplastic deformation only after an initial non-superplastic deformation to achieve dynamic recrystallisation characterised by the sequential steps of:

(1) holding the previously hot-rolled blank at a temperature between 275° C. and 425° C. for between 1 and 24 hours (2) allowing the blank to cool to a temperature suitable for cold forming (3) cold forming the blank in at least two stages and (4) annealing the cold formed blank between each of said stages at a temperature of between 300° C. and 400° C. for no more than 2 hours using a controlled heat-up rate of between 10° C. and 200° C./hour and allowing the annealed product to cool.

The grain controlling additive may be Zr in a quantity no more than 0.3% and preferably less than 0.2%.

Preferably after the last cold forming stage the product is finally annealed at a temperature between 450° C. and 500° C. for no more than 2 hours using a controlled heat-up rate of between 40° C. and 200° C./hour.

The cold forming step is preferably cold rolling.

The highly recovered semi-fabricated wrought product of the present invention may be a cellular dislocation structure with a cell diameter of approximately 10 micrometers. The cells are separated from one another by low angle boundaries and are contained within the grains. These grains may have been derived from the cast ingot from which the blank is derived and their "as cast" diameter is preferably in the range of 75 to 500 micrometers.

BRIEF DESCRIPTION OF DRAWING

The above and other aspects of the present invention will now be described by way of example with reference to the accompanying drawings in which.

DETAILED DESCRIPTION OF EMBODIMENTS

Samples of 8090 6 mm sheet which had previously been hot-rolled were subjected to the following processing:

(a) heavily cold rolled as in Route 1 above (b) heavily cold rolled but annealed at 350° C. during cold rolling (c) hot blank heat treated and cold rolled (d) hot blank heat treated and cold rolled but annealed at 350° C. during cold rolling.

In all cases the cumulative cold rolled reduction was 75%.

The samples were then all subjected to the same, known, high temperature deformation step. In each case the samples were pre-heated at 520° C. for 10 minutes prior to deforming at a constant crosshead velocity (ccv) of 1.5 mm/min (an initial strain rate of $2\times10^{-3}$/sec).

The results of deformation were as follows:

| | Superplastic Deformation (%) | |
|---|---|---|
| Sample | L-direction | T-direction |
| (a) | 380 | 400 |
| (b) | 370 | 350 |
| (c) | 550 | 420 |
| (d) | 660 | 610 |

For (b) and (d) annealing at 350° C. would have been after approximately each 20% of cold reduction (i.e.) 20% cold work—inter-anneal—20% cold work etc.

In sample (a) (identical to Route 1) dynamic recrystallisation occured as it also did in sample (b). If an intermediate anneal is applied to the "known" route 1 alloys" (i.e. 2004) there is a major drop in superplasticity, quite possibly to the point that the sheet is no longer superplastic. The 8090 processed as example (b) behaved very differently from similarly treated 2004 in so far as the intermediate annealing treatment had virtually no effect upon the superplastic behaviour of the sheet.

In sample (c) improved superplastic deformation was obtained. The blank heat treatment procedure used was similar to that of Route 2 and it might have been expected that during the pre-heat for 10 minutes at 520° C. a statically recrystallised grain structure would have developed but optical metallography showed this not to be the case. In addition, in sample (d) annealing during cold rolling gave a further improvement in superplastic deformation. This was unexpected.

Figure 1:
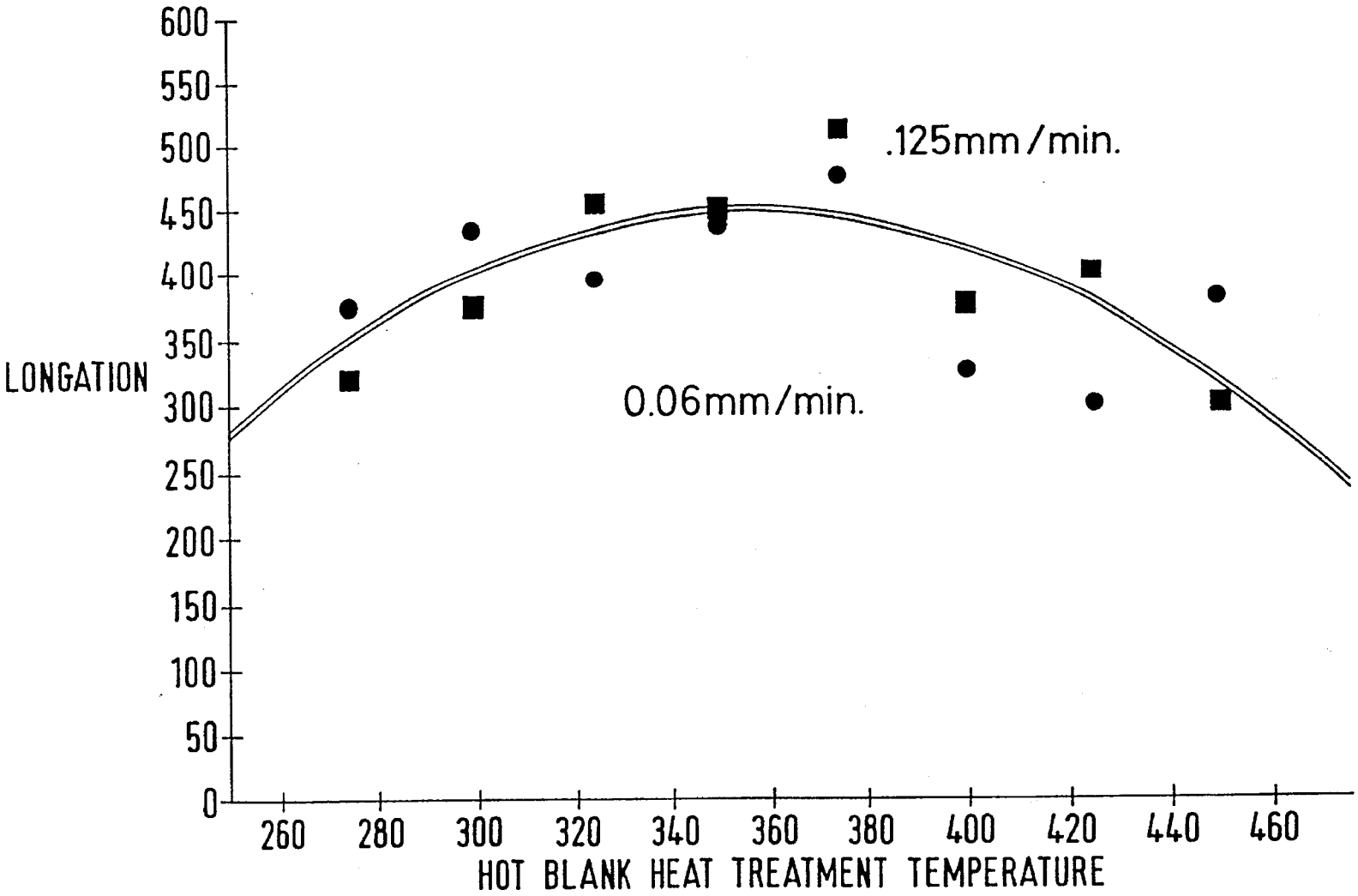
FIG. 1 is a graph of hot blank heat treatment temperature against subsequent superplastic deformation for alloys 8090 and 8091.

As shown in FIG. 1, the curve illustrated is a fair average of samples respectively deformed at cross head velocities of 12.5 mm/minute and 1.5 mm/minute (initial strain rates of $1.5\times10^{-3}$/sec and $2\times10^{-3}$/sec respectively). FIG. 1 shows that 350° C. is an optimum temperature for 8090 to produce maximum subsequent superplastic deformation for material heat treated for 16 hours. In practice we have found that heat treatment temperatures between 275° C. and 450° C. produce reasonable superplasticity in the alloy. It will be obvious to anyone skilled in the art that the heat treatment process is a diffusion controlled phenomenon and is thus controlled by the conjoint effects of time and temperature. Thus both time and temperature can be varied continuously to produce the necessary degree of microstructural change required to improve the material's subsequent superplastic performance. Treatment at 350° C. for 16 hours has been shown to be optimum for 8090 and produce similar results in 8091. Other alloys may differ from this practice because of differences in their phase diagram and the diffusion rates of their solute elements.

Figure 2:
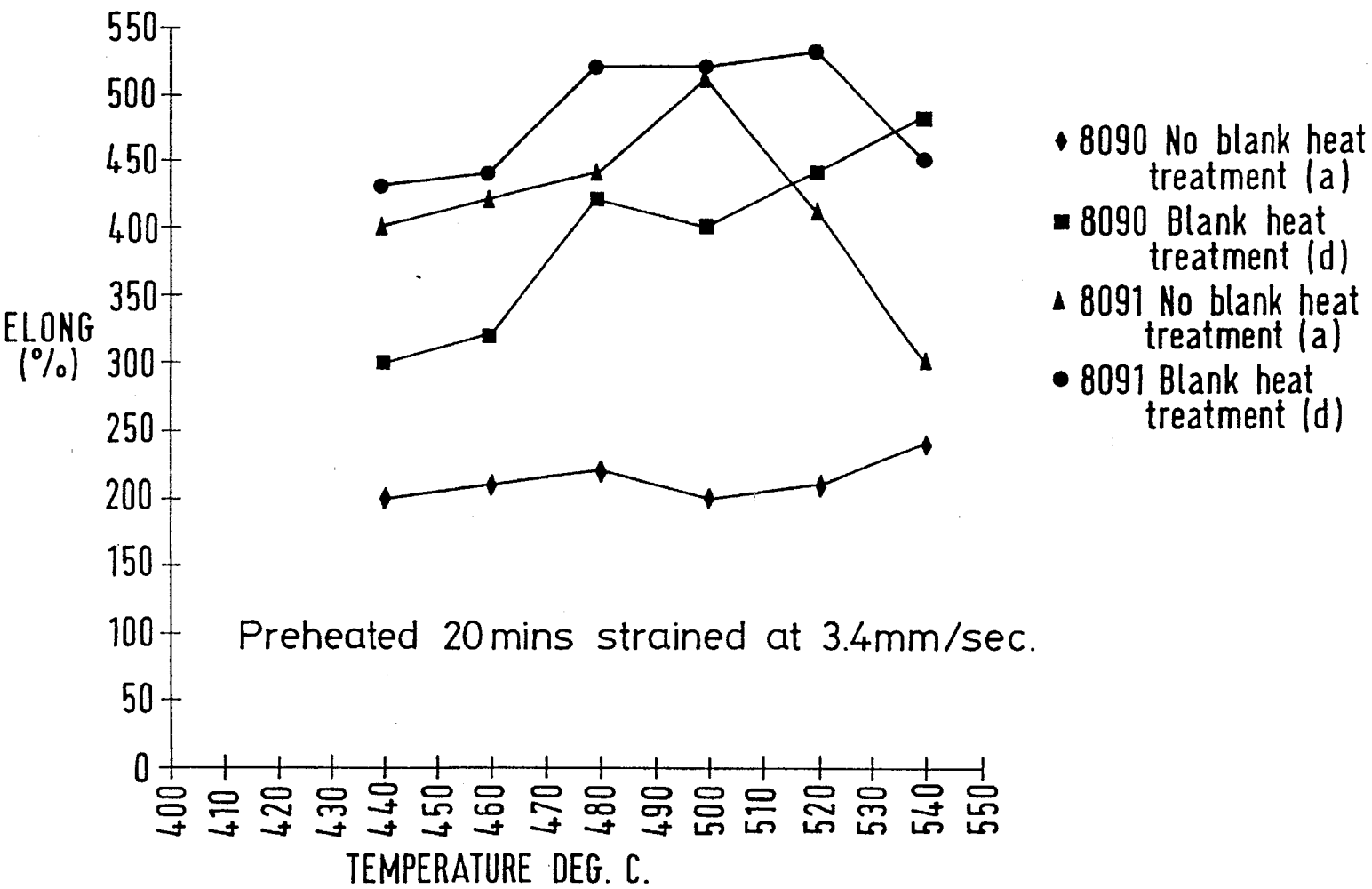
FIG. 2 is a graph showing the affect of temperature on the superplastic performance of alloys 8090 and 8091.
Figure 3:
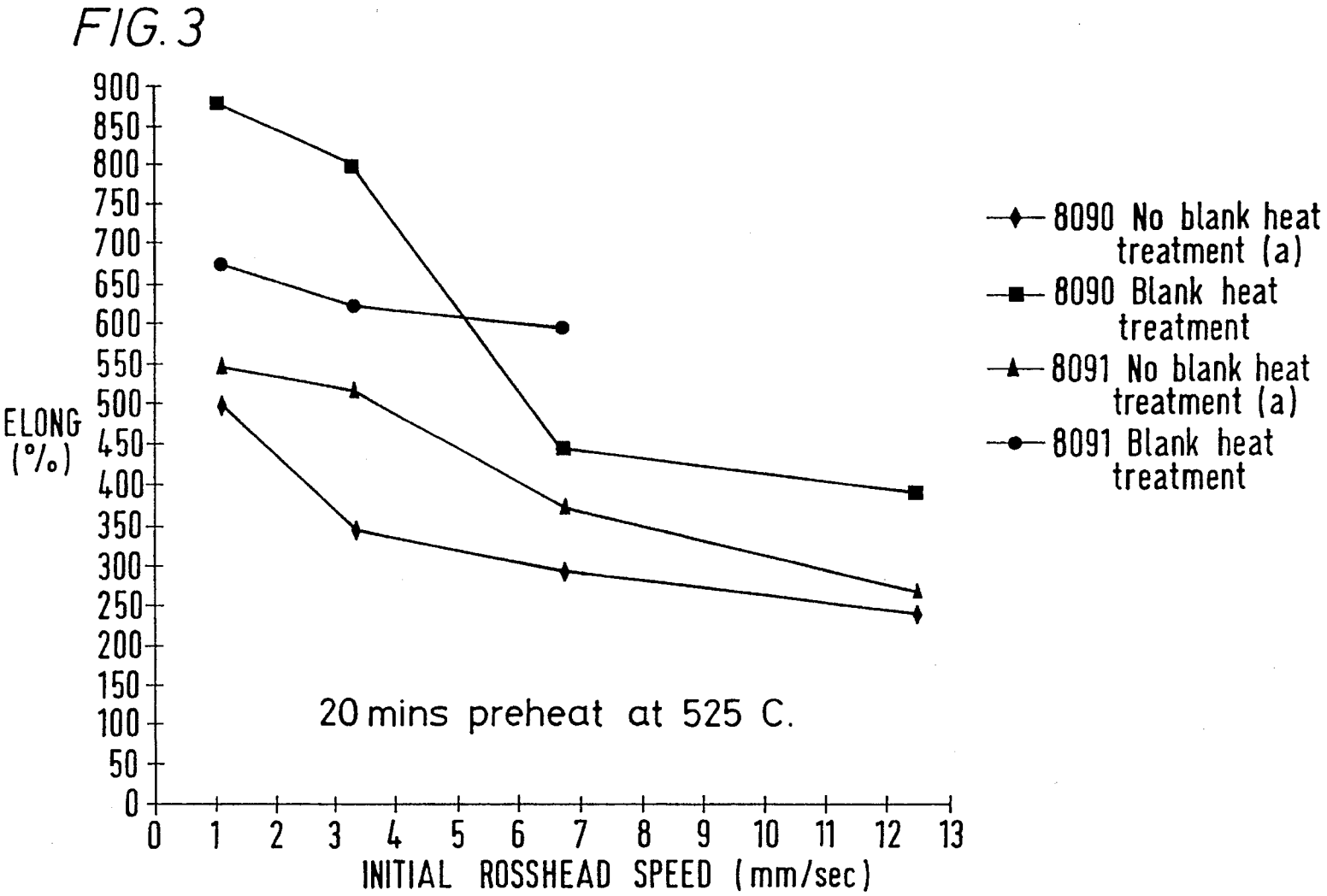
FIG. 3 is a graph showing the effect of strain rate on the superplastic performance of alloys 8090 and 8091.

FIGS. 2 and 3 show curves for alloys 8090 and 8091 treated as for samples (a) and (d). The examples in FIG. 2 were all preheated for 20 minutes at 525° C. and tensile tested at a constant crosshead velocity of 3.4 mm/min (initial strain rate of $4.5\times10^{-3}$/sec). In FIG. 3 there was also a preheat step for 20 mins at 525° C. The benefits of samples (d) are clearly apparant. Furthermore these samples are superplastic at a higher deformation temperature than samples (a) which is also advantageous.

Specifically in FIG. 1 blank heat treatment improves 8090's superplastic performance by a factor of 2½ to 2. The improvement in superplastic ductility increases with increasing test temperature. In the case of 8091 the improvement in superplasticity with blank heat treatment is small below 500° C., but is significant above 500° C., i.e. within the solution treatment temperature range of the alloy. FIG. 3 shows that when tested at the alloy's solution treatment temperature (525° C.) the improvement in superplasticity with blank heat treatment is maintained over a wide range of crosshead velocities for both alloys.

Further experiments were made with 8090 and 8091 alloys treated as for sample (d) and then subjected to a variety of final annealing treatments prior to superplastic deformation. It should here be noted that the superplastic performances of alloys processed according to the known Routes 1 and 2 would decline if they were subjected to a final annealing process. The results of the final annealing were as follows:

| | Superplastic Elongation | | | |
|---|---|---|---|---|
| | 8090 Alloy | | 8091 Alloy | |
| Final Anneal | L-Direction | T-Direction | L-Direction | T-Direction |
| none | 410 | 240 | 500 | 600 |
| 1 h at 350° C. | 405 | 270 | 560 | 570 |
| 1 h at 450° C. (50° C./h heat-up) | 515 | 320 | 750 | 650 |
| 20 min at 520° C. (50° C./h heat-up) | 180 | 130 | 200 | 330 |

Test conditions 10 min preheat to 520° C. constant crosshead velocity test at 3.4 mm/min (initial strain rate $2 \times 10^{-3}$/sec).

These results show that annealing at 350° C. (a temperature which somewhat reduces the stored energy from the cold rolling process) does not significantly alter the alloys, superplastic forming capability because sufficient stored energy of cold rolling remains for some static recrystallisation to occur as the metal is subsequently raised to temperature for superplastic forming. Annealing at 450° C. with a controlled heat-up rate improves the superplastic forming capability substantially (at this temperature cold work is removed from the alloy and substantial recovery takes place) but almost no static recrystallisation occurs. However if the annealing temperature is increased to 520° C. (the solution treatment temperature) then superplastic forming capability is significantly reduced. We interpret this as being due to complete solutionising of the blank heat treatment precipitates removing obstacles to grain boundary movement allowing partial recrystallisation and some grain coarsening. These latter processes render the structure unsuitable for superplastic forming.

A series of 8 mm and 10 mm sheets which had previously been hot-rolled of 8090 were then processed as follows:

Sample 1—8 mm hot blank: Heat treated for 16 h at 350° C.: cold straight rolled to 4 mm: Annealed during cold rolling at 6 mm for 10 mins at 350° C.

Sample 2—As sample 1 but rolling was at right angles to hot rolling direction (cross-rolled).

Sample 3—As sample 2 with additional interanneal at 5 mm for 10 mins at 350° C.

Sample 4—As sample 2 but with a starting gauge of 10 mm.

Sample 5—As sample 2 but heat treatment was carried out after solution treating the hot blank for 30 mins and slow cooling to the heat treatment temperature.

The following table details the superplastic forming performance of the material with and without a final anneal at 450° C. (15 min soak 50° C./h heat-up).

| | Superplastic Ductility | | | |
|---|---|---|---|---|
| | As Rolled | | Annealed at 450° C. | |
| Sample | L-Direction | T-Direction | L-Direction | T-Direction |
| 1 | 160 | 100 | 350 | 230 |
| 2 | 170 | 180 | 510 | 600 |
| 3 | 170 | 175 | 470 | 450 |
| 4 | 200 | 170 | 475 | 440 |
| 5 | 150 | 150 | 320 | 345 |

Test Condition 10 min preheat to 520° C. Initial Strain Rate $2.0 \times 10^{-3}$ $sec^{-1}$ (constant crosshead velocity 3.4 mm/min).

CONCLUSIONS

1. The final annealing gives a significant improvement in superplastic forming capability in all cases.
2. Cross rolling gives a significant reduction in anisotropy of superplastic forming capability.

Further optimisation of superplastic forming capability was carried out under various test conditions for samples 2 to 5 with all the material given a final anneal at 450° C. prior to superplastic deformation. The results are as follows:

| | | | Alloy 8090 | | | | | | | |
|---|---|---|---|---|---|---|---|---|---|---|
| Temp | Preheat Time | Initial Strain | Sample 2 | | Sample 3 | | Sample 4 | | Sample 5 | |
| °C. | Min | Rate $sec^{-1}$ | L | T | L | T | L | T | L | T |
| 505 | 10 | $2 \times 10^{-3}$ | 470 | 480 | 440 | 610 | 430 | 460 | 340 | 300 |
| 520 | 10 | $2 \times 10^{-3}$ | 510 | 600 | 470 | 450 | 475 | 440 | 320 | 345 |
| 545 | 10 | $2 \times 10^{-3}$ | 430 | 420 | 550 | 560 | 500 | 450 | 340 | 460 |
| 530 | 10 | $4.5 \times 10^{-3}$ | 310 | 360 | 280 | 350 | 300 | 320 | 195 | 170 |
| 530 | 10 | $8.6 \times 10^{-3}$ | 240 | 280 | 280 | 300 | 220 | 240 | 195 | 220 |
| 530 | 10 | $2.0 \times 10^{-3}$ | 480 | 490 | 525 | 460 | 420 | 460 | 330 | 350 |

CONCLUSIONS

1. All material shows superplastic forming capability in the solution treatment temperature range (500° to 545° C.) and at strain rates used commercially).

Sample 5 has the lowest overall superplastic capability. Thus solution treating prior to lower temperature heat treatment is not preferred.

Sample 3 has the better Superplastic capability particularly at the higher strain rates and higher test temperatures. There is little difference with different starting gauges.

CAVITATION

Figure 4:
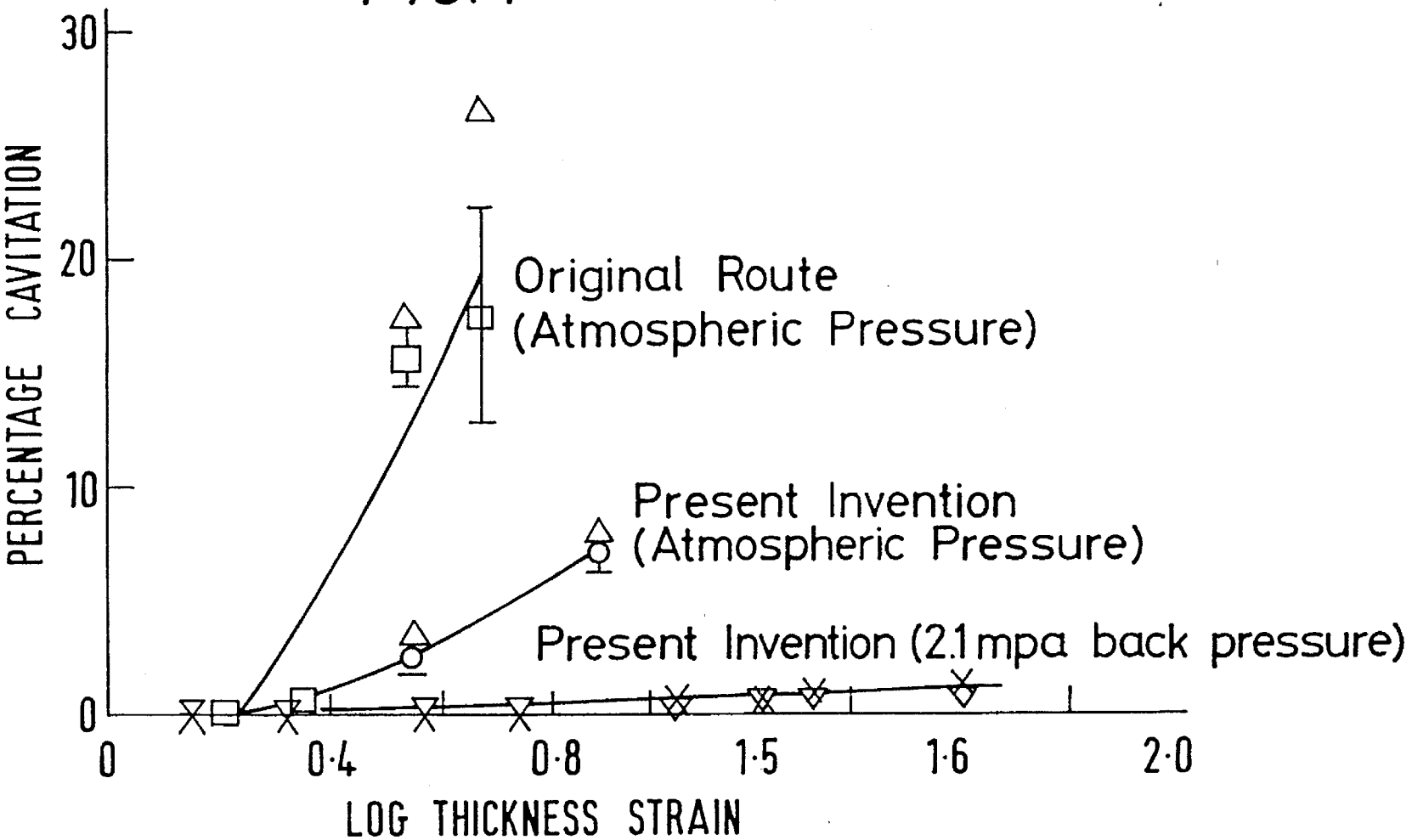
FIG. 4 is a graph showing variation in cavitation in the same material processed according to the present invention and by a previously known method, FIGS. 5 and 5*a*; 6 and 6*a*; 7 and 7*a* and 8 and 8*a* show grain structure, for different strain rates, in the same material processed according to the present invention and by a previously known method.

FIG. 4 shows the cavitation observed in optimised route material compared to that found in the same alloy processed using Route 1 above.

A significant reduction in cavitation is found in the optimum route material.

GRAIN STRUCTURE DEVELOPMENT

FIGS. 5, 5*a*; 6, 6*a*; 7, 7*a* and 8, 8*a* compare the grain structure observed during superplastic forming of optimised route material compared to material processed via route 1.

The optimised route material develops a fine grain structure (necessary for good superplastic performance and low flow stress) at a much earlier stage of straining.

Transmission electron microscopy has been carried out on material in the as-rolled+ final anneal state and in undeformed regions of samples held at the forming temperature prior to straining. We have found that in material processed according to the optimum route of the present invention has an unrecrystallised grain structure with a uniform structure whereas route 1 material is unrecrystallised grain structure with a non-uniform structure. In an undeformed region the optimum route is recovered whereas the route 1 material is un-recrystallised.

Thus it can be stated that in the prior art route 2, the essential is that a fine grain statically recrystallised structure is produced during processing and prior to superplastic deformation. It is not practicable to produce the fine grain structure in the preheat prior to superplastic deformation since the heating rate is too slow and generally not closely controlled. With route 1, this starts with an un-recrystallised structure which does not change significantly during the preheat to superplastic deformation. It transforms to a fine grain structure under the conjoint effects of strain and temperature to produce dynamic recrystallisation but the strain required to produce a fully recrystallised fine grained structure can be quite large.

Both these routes can develop superplastically deformable Al/Li alloys. In route 2 this requires complex processing (because of the difficulty in statically recrystallizing to a fine grain structure (see I. G. Palmer, W. S. Miller, D. J. Lloyd, M. J. Bull in Aluminium Lithium 3 P565). In route 1 the superplastic performance tends to be variable because of the insufficient quantity of zirconium in the alloy (up to 0.3 wt %).

FLOW STRESS MEASUREMENTS

We have found that the optimised route 8090 material of the above summary shows a flow stress of 5.3 MPa (L-direction) 4.8 MPa (T-direction)

This compares to values of 7.8 MPa (L-direction) and 7.9 MPa (T-direction) measured for the same alloy processed without any annealing steps. All tests showing the above results were carried out at 525° C. at an initial strain rate of $2\times10^{-3}$/sec thus the optimum route processing can reduce flow stress by 33%.

Figure 9:
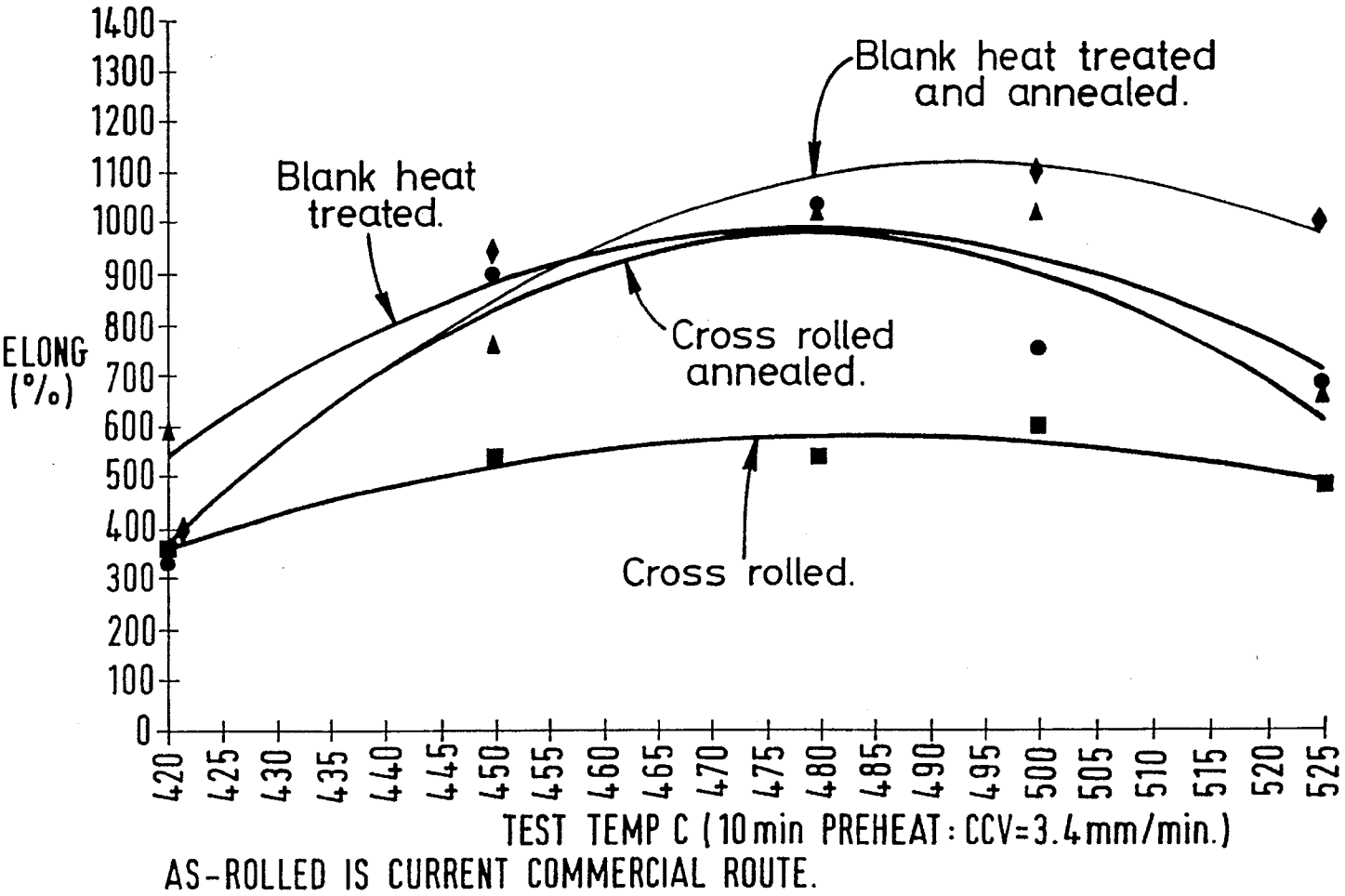
FIG. 9 is a graph showing the affect of various treatments on the superplastic performance of 2004.
Figure 10:
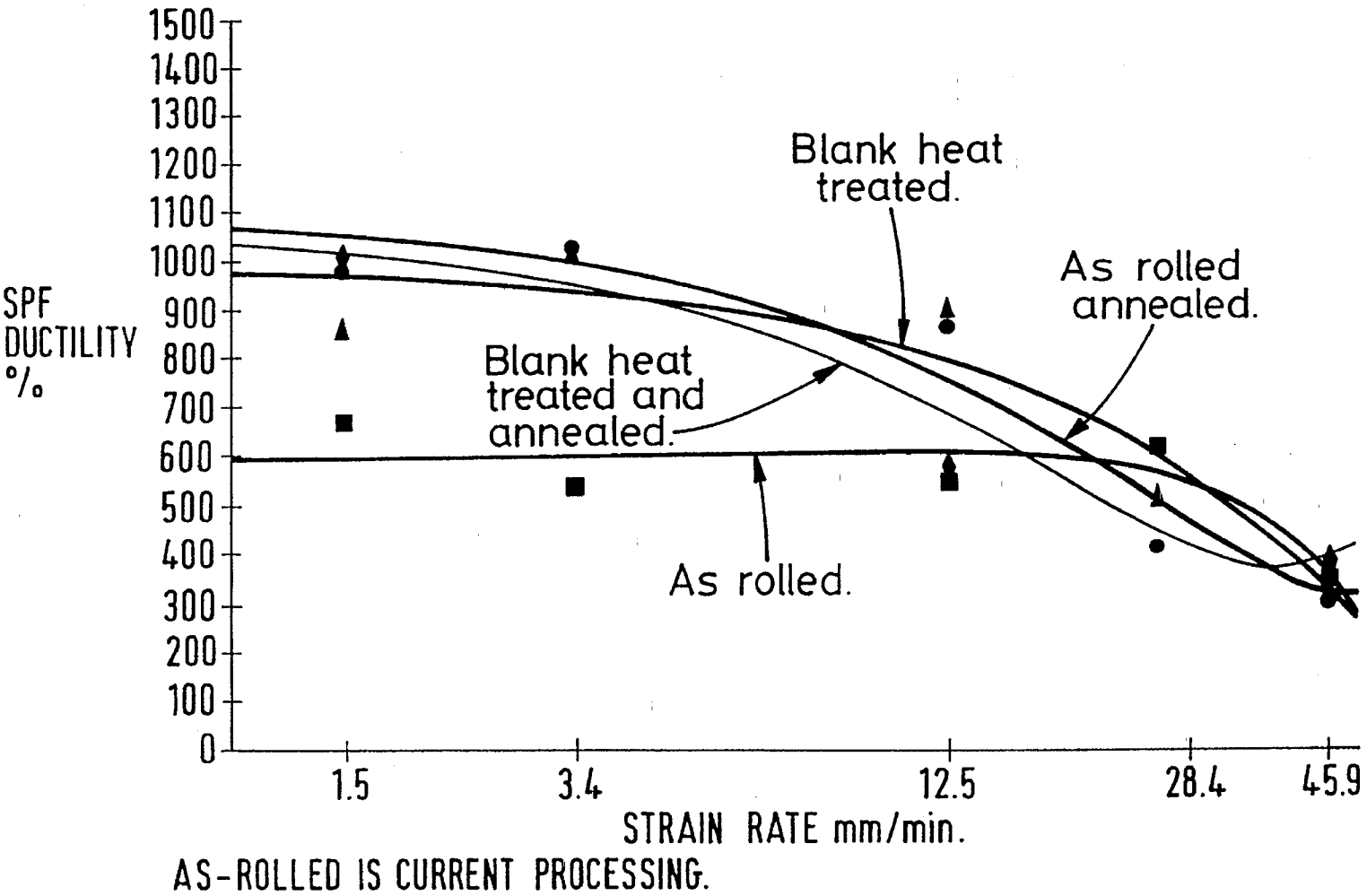
FIG. 10 is a graph showing the affect on ductility of various strain rates for 2004 treated as in FIG. 9, and FIGS. 11 and 12 are graphs similar to FIG. 9 respectively for alloys 7010 and 7050.

Alloy 2004 is normally produced using the method of Route 1 above and good superplastic behaviour results. However FIGS. 9 and 10 show that alloy 2004 can be processed with advantage in accordance with the present invention. This improves the superplastic forming properties and increases the optimum forming temperature thus allowing easier control of cavitation during superplastic forming. The cold rolling operation can also be rendered easier by use of the present invention. With 2004 we have found that the final annealing step generally has little effect because a very efficient grain controlling dispersion of $ZrAl_3$ particles is normally present in the alloy.

Figure 11:
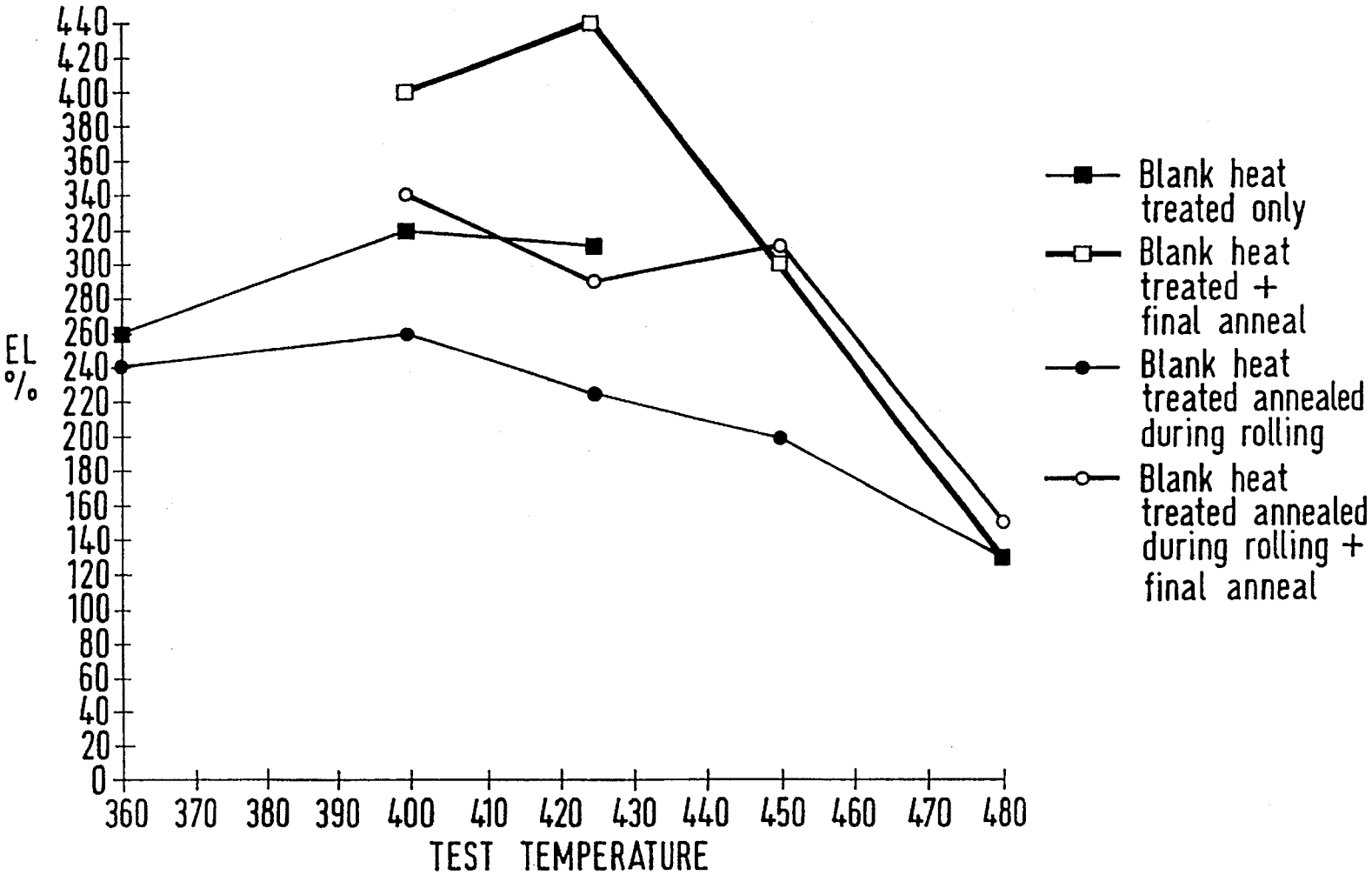
Figure 12:
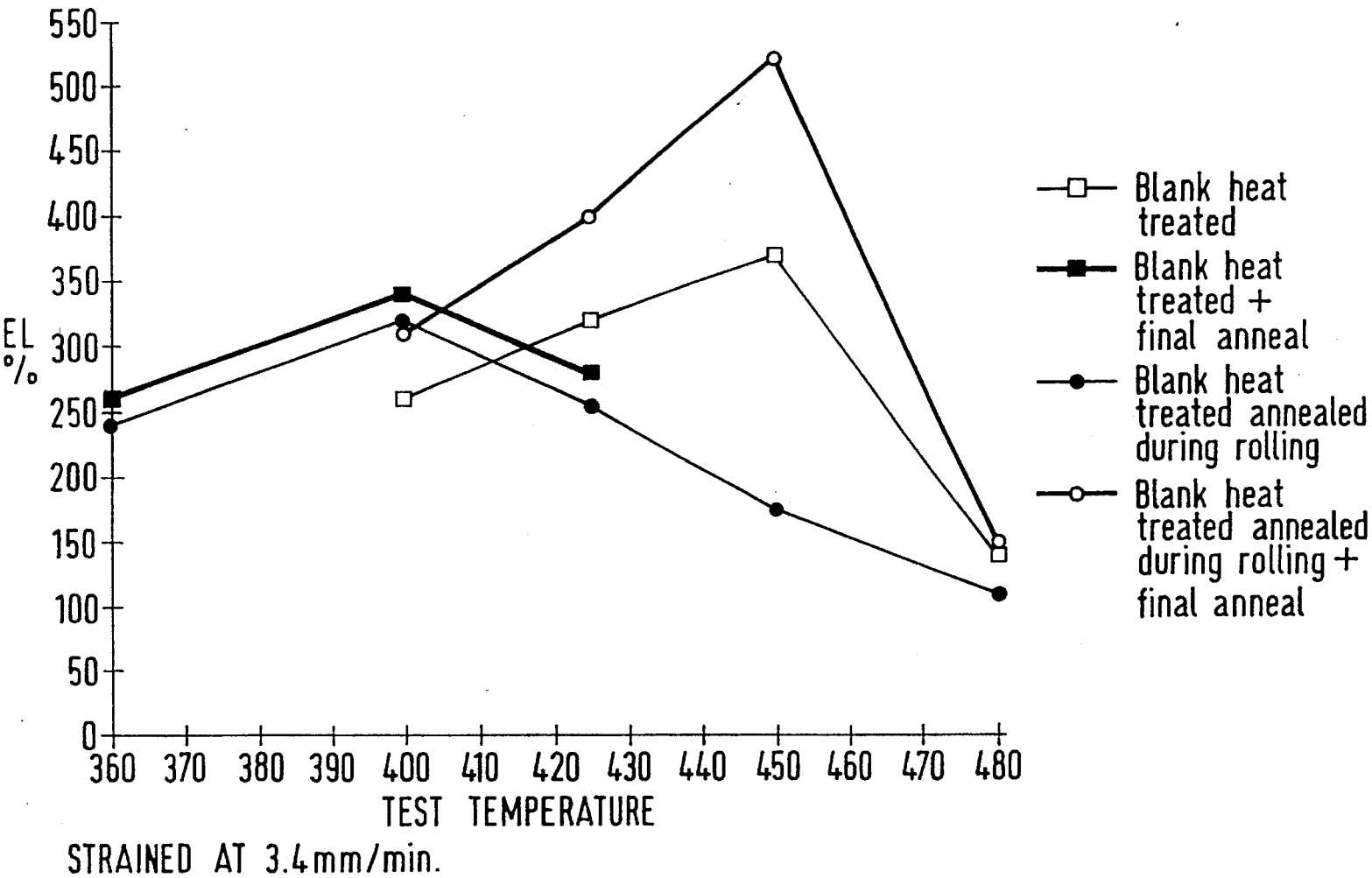

We have also found, as shown in FIGS. 11 and 12 that the present invention can be applied with advantage to 7000 series alloys; particularly 7010 and 7050, both containing Zr.

In the present invention the essential feature is to develop via the processing a highly recovered wrought product but to avoid static recrystallisation. This highly recovered structure leads to improved superplastic elongations, reduced tendency for the alloy to cavitate during deformation and a lower flow stress. All these features are desirable requirements for an alloy that is to be superplastically deformed.

It will thus be understood that the present invention provides a superplastic forming route for Al base alloys in which the starting material is subjected to heating rates at such temperatures and for such times and to such cold forming operations that static recrystallisation is substantially avoided both during annealing and during pre-heat for superplastic forming. More specifically we have found the following parameters suitable:

| Starting Material | Hot rolled blank |
|---|---|
| Low temperature annealed for | 16 hour at 350° C.<br>(See FIG. 1 for range in temp.)<br>(Preferred to anneal directly) |
| Cold roll to final gauge | Preferred to cross roll<br>Require approx 50% cold work |
| Interannealing | Interanneal during cold rolling<br>At least once during cold rolling<br>(Preferred every 20 to 25% cold reduction)<br>(Preferred temp is 350° C., no soak, 50° C./h heat up) |
| Final Anneal | This should be at a temperature of at least 350° C. but below the alloy's solution treatment temperature. A controlled heat-up is necessary to avoid static recrystallisation. Preferably the temperature should be 450° C. (plus/minus 25) with a heat up rate of 50 to 100° C./hour and a soak period of 1 to 15 minutes. |

The basic superplastic processing route described above was developed from work on alloys 8090 and 2004.

The processing route has also been applied starting from a book-mould casting of nominal composition Al-6Cu-1.3Li-0.4 Mg-0.4Ag-0.14Zr. This involved:

(i) extrusion with a 20:1 extrusion ratio into 55 mm×4.5 mm section (ii) over-ageing for 16 hours at 350° C.

(iii) cold cross-rolling to 3.5 mm gauge (iv) annealing for 15 minutes at 350° C.

(v) further cold rolling to 2 mm gauge (vi) final annealing by heating at 50° C./hour to 450° C.

The sheet has been tested under uni-axial tension whilst subjected to a hydrostatic pressure of 650 psi. At 485° C. using a strain rate of $1\times10^{-3}$ $s^{-1}$ an elongation to failure of 400% was obtained. The flow stresses have been measured as a function of strain rate, and from this the superplasticity index, m, obtained. These values are shown in Table 1.

TABLE I

| Flow Stress and m Value Variation with Strain Rate at T = 485° C. | | |
|---|---|---|
| Strain Rate ($s^{-1}$) | Flow Stress (MPa) | m Value |
| $2.5 \times 10^{-5}$ | 2.59 | 0.25 |
| $5 \times 10^{-5}$ | 3.16 | 0.33 |
| $7.5 \times 10^{-5}$ | 3.72 | 0.37 |
| $1 \times 10^{-4}$ | 4.14 | 0.40 |
| $2.5 \times 10^{-4}$ | 6.04 | 0.45 |
| $5 \times 10^{-4}$ | 8.25 | 0.47 |
| $7.5 \times 10^{-4}$ | 10.05 | 0.47 |
| $1 \times 10^{-3}$ | 11.69 | 0.46 |
| $2.5 \times 10^{-3}$ | 17.54 | 0.43 |
| $5 \times 10^{-3}$ | 22.98 | 0.38 |

These results clearly demonstrate that the process produces genuine superplasticity in this alloy without the need for compostional modifications.

The mechanism by which this occurs has been investigated using optical microscopy at various stages of the process. This has shown that the microstructure of the final superplastically formed sheet has a recovered substructure. During superplastic forming it is recrystallised dynamically to produce a fine-grained microstructure typical of superplastic materials.

The highly recovered semi-fabricated wrought product of the present invention may be a cellular dislocation structure with a cell diameter of approximately 10 micrometers. The cells are separated from one another by low angle boundaries and are contained within the grains. These grains may have been derived from the cast ingot from which the blank is derived and their "as cast" diameter is preferably in the range of 75 to 500 micrometers.

We claim:

1. A method of treating a blank of an aluminium base alloy comprising the steps of hot rolling the blank and thereafter applying a combination of heat treatments and cold forming operations to produce a highly recovered semi-fabricated wrought product which is inherently non-superplastic and is capable of superplastic deformation only after an initial non-superplastic deformation to achieve dynamic recrystallization, wherein said combination comprises at least two said cold forming operations separated by an intermediate annealing step, and wherein said cold forming operations of said combination are such, and said heat treatments of said combination entail temperatures, heating rates and times such that application of said combination substantially avoids recrystallization between the commencement of the first cold forming step and completion of the last cold forming step of the combination, each said cold forming step providing a reduction ratio no greater than 43%.

2. A method of treating a blank of an aluminium base alloy to produce a highly recovered semi-fabricated wrought product that is inherently non-superplastic and is capable of superplastic deformation only after an initial non-superplastic deformation to achieve dynamic recrystallization, the method comprising the sequential steps of:

(1) hot rolling the blank;

(2) holding the previously hot worked blank at a temperature between 275° C. and 425° C. for between 1 and 24 hours;

(3) allowing the blank to cool to a temperature suitable for cold forming;

(4) cold forming the blank in a first stage providing a reduction ratio no greater than 43%;

(5) annealing the cold formed blank, so as to avoid recrystallization, at a temperature of between 300° C. and 400° C. for no more than 2 hours using a controlled heat-up rate of between 10° C. and 200° C./hour, and allowing the annealed product to cool, and (6) cold forming the blank in a second stage providing a reduction ratio no greater than 43%.

3. A method according to claim 2 wherein the reduction ratio in each of said cold forming stages is no greater than 25%.

4. A method according to claim 2 wherein the alloy contains Zr as a grain controlling additive in a quantity no more than 0.3%.

5. A method according to claim 4 in which the quantity of said Zr is less than 0.2%.

6. A method according to claim 2 in which the product is finally annealed at a temperature between 450° C. and 500° C. for no more than 2 hours using a controlled heat-up rate of between 40° C. and 200° C./hour.

7. A method according to claim 6 in which the rate is approximately 50° C./hour.

8. A method according to claim 2 in which the highly recovered semi-fabricated product is a cellular dislocation structure with a cell diameter of approximately 10 micrometers.

9. A method according to claim 8 in which the cells are separated from one another by low angle boundaries and are contained within the grains.

10. A method according to claim 8 in which the grains are derived from a cast ingot from which the blank is derived and their "as-cast" diameter is in the range of 75 to 500 micrometers.

11. A method of treating a blank of an aluminium base alloy to produce a highly recovered semi-fabricated wrought product, comprising the sequential steps of:

(1) hot rolling the blank;

(2) holding the blank at a temperature between 275° C. and 425° C. for between 1 and 24 hours;

(3) allowing the blank to cool to a temperature suitable for cold forming;

(4) cold working the blank to provide a reduction ratio of no more than 43% so as to maintain stored energy within said blank at a level below that which would cause recrystallization during subsequent annealing;

(5) annealing at a low temperature to provide a recovered structure and avoid recrystallization; and (6) cold working to provide a reduction ratio of no more than 43% so as to maintain stored energy at a level below that which would cause recrystallization during subsequent heating.

12. A method according to claim 11 wherein the reduction ratio in each of said stages (4) and (6) is no greater than 25%.

13. A method according to claim 11 wherein said annealing of step (5) is carried out at a temperature of between 300° C. and 400° C. for no more than two hours using a controlled heat-up rate of between 10° C. and 200° C. per hour, followed by allowing the annealed product to cool.

14. A method according to claim 11, wherein step (6) is followed by a step (7) in which the blank is annealed at 450° C. to 500° C. for up to two hours using a controlled heat-up rate of 40° C. to 200° C. per hour.

15. A method according to claim 12, wherein step (6) is followed by a step (7) in which the blank is annealed at 450° C. to 500° C. for up to two hours using a controlled heat-up rate of 40° C. to 200° C. per hour.

16. A method according to claim 13, wherein step (6) is followed by a step (7) in which the blank is annealed at 450° C. to 500° C. for up to two hours using a controlled heat-up rate of 40° C. to 200° C. per hour.

* * * * *